US006234620B1

(12) United States Patent
Faisst, Jr. et al.

(10) Patent No.: US 6,234,620 B1
(45) Date of Patent: May 22, 2001

(54) CONTINUOUS INK JET PRINTER CATCHER AND METHOD FOR MAKING SAME

(75) Inventors: Charles F. Faisst, Jr., Avon; James M. Chwalek, Pittsford; John A. Lebens, Rush, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/342,371

(22) Filed: Jun. 29, 1999

(51) Int. Cl.[7] ..... B41J 2/185
(52) U.S. Cl. ..... 347/90
(58) Field of Search ..... 347/89, 90, 77, 347/82

(56) References Cited

U.S. PATENT DOCUMENTS

| | | | |
|---|---|---|---|
| 1,941,001 | 12/1933 | Hansell | 178/96 |
| 3,287,734 | 11/1966 | Kazan | 347/53 |
| 3,878,519 | 4/1975 | Eaton | 347/75 |
| 4,070,679 | 1/1978 | Fan et al. | 347/75 |
| 4,107,699 | 8/1978 | Kenworthy | 347/47 |
| 4,290,073 | 9/1981 | Jinnai et al. | 347/77 |
| 4,338,613 | 7/1982 | Cruz-Uribe | 347/82 |
| 4,442,440 | 4/1984 | Elchinger | 347/74 |
| 4,460,903 | 7/1984 | Guenther et al. | 347/90 |
| 4,573,057 | 2/1986 | Sutera et al. | 347/74 |
| 4,591,869 | 5/1986 | Katerberg et al. | 347/21 |
| 4,591,873 | 5/1986 | McCann et al. | 347/25 |
| 4,600,928 | 7/1986 | Braun et al. | 347/27 |
| 4,613,871 | 9/1986 | Katerberg | 347/76 |
| 4,636,808 | 1/1987 | Herron | 347/76 |
| 4,658,269 | 4/1987 | Rezanka | 347/45 |
| 4,757,328 | 7/1988 | Braun et al. | 347/90 |
| 4,929,966 | 5/1990 | Sexton et al. | 347/90 |
| 5,105,205 | 4/1992 | Fagerquist | 347/90 |
| 5,394,177 | 2/1995 | McCann et al. | 347/7 |
| 5,410,342 | 4/1995 | Lecheheb et al. | 347/77 |
| 5,434,609 | 7/1995 | Rhodes | 347/77 |
| 5,469,202 | 11/1995 | Stephens | 347/90 |
| 5,475,411 | 12/1995 | Strain et al. | 347/90 |
| 5,489,929 | 2/1996 | Vago | 347/55 |

FOREIGN PATENT DOCUMENTS 56-21866 2/1981 (JP) .

OTHER PUBLICATIONS

Internet Article from the Technical University of Berlin; Prof. Dr.–Ing. Ernst Obermeier, A Micrhomachines Continuous Ink Jet Print Head for High Resolution Printing; pp. 1–5, May 3, 1999.

*Primary Examiner*—N. Le
*Assistant Examiner*—Michael Nghiem
(74) *Attorney, Agent, or Firm*—Milton S. Sales

(57) ABSTRACT

A catcher assembly, which is adapted to catch non-print droplets while not catching print droplets, includes a section defining an ink collection chamber and an impact surface positioned to intercept non-print droplets and to direct the intercepted non-print droplets to the ink collection chamber. The section further defines at least one other surface that is subject to undesirable ink build up. An ink flow path extends from the other surface to the ink collection chamber, whereby ink that has undesirably built up on the other surface will tend to flow to the ink collection chamber. The ink flow path may be a hole through the section. The hole extends from the other surface to the ink collection chamber. The ink flow path may further include a slot in the section extending between the hole and the other surface to provide a path for ink to flow from the other surface to the hole and then through the hole to the ink collection chamber. The ink flow path may be formed by a backing plate spaced from the section to form a conduit extending from the other surface to the ink collection chamber.

6 Claims, 2 Drawing Sheets

CONTINUOUS INK JET PRINTER CATCHER AND METHOD FOR MAKING SAME

FIELD OF THE INVENTION

This invention relates generally to the field of digitally controlled printing devices, and in particular to continuous ink jet printers in which a liquid ink stream breaks into droplets which are selectively collected by a catcher and prevented from reaching a receiver.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfers and fixing ink jet printing mechanisms can be categorized as either continuous ink jet or drop on demand ink jet.

Continuous ink jet printing dates back to at least 1929. See U.S. Pat. No. 1,941,001 to Hansell. Conventional continuous inkjet utilizes electrostatic charging tunnels that are placed close to the point where the drops are formed in a stream. In this manner individual drops may be charged. The charged drops may be deflected downstream by the presence of deflector plates that have a large potential difference between them. A catcher (sometimes referred to as a "gutter") may be used to intercept either the charged or the uncharged drops, while the non-intercepted drops are free to strike a receiver or recording medium. U.S. Pat. No. 3,878,519, which issued to Eaton on Apr. 15, 1975, discloses a method and apparatus for synchronizing droplet formation in a liquid stream using electrostatic deflection by a charging tunnel and deflection plates. The function of a deflection charge plate and its associated catcher in a continuous jet printer is well known, being described in U.S. Pat. No. 4,107,699 which issued to Kenworthy on Aug. 15, 1977, The catcher may be an integral part of systems which serve multiple functions, including: blocking unwanted ink droplets, collecting and removing unwanted ink droplets, measuring drop charge levels, recycling ink, and solving start-up and shut-down problems.

Individual ink droplets receive an electrical charge. An opposite electrical charge is applied to the surface of a catcher parallel to the normal trajectory of the ink stream. The opposite polarities create an attraction force that deflects the droplets toward and onto the surface of the catcher. However, the disadvantage of this type of catcher is that when ink strikes the surface of the catcher the force of the drop impact causes the ink to splatter and/or mist. Ink splatter and mist creates unwanted artifacts on the printed media that reduces image quality and the splatter and mist contaminate other components in the printer.

U.S. Pat. No. 4,757,328, which issued to Braun et al. on Jul. 12, 1988, illustrates an assembly of a catcher that minimizes splattering and misting. However, this type of catcher affects print quality in other ways. The need to create an electric charge on the catcher surface complicates the construction of the catchers and it requires more components. This complicated catcher structure requires large spatial volumes between the print head and the media, increasing the ink drop trajectory distance. Increasing the distance of the drop trajectory decreases drop placement accuracy and affects the print image quality. There is a need to minimize the distance the drop must travel before striking the print media in order to insure high quality images.

Scanning type ink jet print heads, such as shown in the Braun et al. patent, experience acceleration forces that "fling" onto the media ink that has built up on the catcher. In order to minimize the amount of ink flung onto the media, a vacuum is commonly applied at one end of an ink removal channel to assist in removing the ink build up. However, air turbulence created by the vacuum decreases drop placement accuracy. Thus, paper dirt and debris is easily collected, causing the catcher to become clogged.

It can be seen that there is a need to provide a simply constructed catcher that reduces ink splattering and misting, increases fluid removal without affecting ink drop trajectory, and minimize clogging of the catcher due to exposure to environmental debris such as paper dust.

DISCLOSURE OF THE INVENTION

It is an object of the present invention to provide a catcher that minimizes the distance that a drop must travel before striking the print media in order to insure high quality images.

It is another object of the present invention to provide a catcher of simple construction.

It is still another object of the present invention to provide a catcher that reduces ink splattering and misting.

It is still another object of the present invention to provide a catcher that increases fluid removal without affecting ink drop trajectory.

It is still another object of the present invention to minimize clogging of the catcher due to exposure to environmental debris such as paper dust.

According to a feature of the present invention, a catcher assembly, which is adapted to catch non-print droplets while not catching print droplets, includes a section defining an ink collection chamber and an impact surface positioned to intercept non-print droplets and to direct the intercepted non-print droplets to the ink collection chamber. The section further defines at least one other surface that is subject to undesirable ink build up. An ink flow path extends from the other surface to the ink collection chamber, whereby ink that has undesirably built up on the other surface will tend to flow to the ink collection chamber.

According to another feature of the present invention, the ink flow path is a hole through the section. The hole extends from the other surface to the ink collection chamber. The ink flow path may further include a slot in the section extending between the hole and the other surface to provide a path for ink to flow from the other surface to the hole and then through the hole to the ink collection chamber.

According to yet another feature of the present invention, the ink flow path may be formed by a backing plate spaced from the section to form a conduit extending from the other surface to the ink collection chamber.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
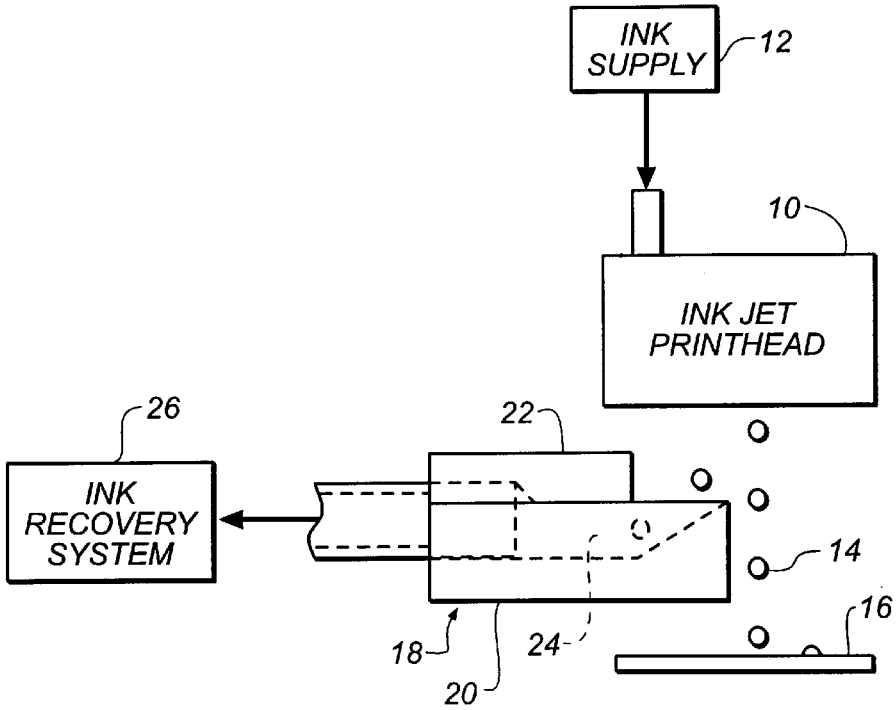
FIG. 1 shows an ink jet printing apparatus, identifying the location of a catcher relative to the print head and media.

Referring to FIG. 1, a print head 10 receives ink from a supply 12 under pressure. As a pressurized ink stream exits from a nozzle opening of the print head, the stream breaks into droplets 14. The droplets are selectively subjected to a force that can be turned on and off at a desired frequency to determine whether each individual droplet strides a recording surface such as a moving paper 16 or falls into a catcher assembly 18. Catcher assembly 18 includes bottom section 20 and a cap 22. Sections 20 and cap 22 form a collection chamber 24 for non-printed droplets from which the droplet can be returned to a reservoir of ink supply 12 via a conduit 26. As illustrated, deflected droplets fall into catcher 18 and non-deflected droplets reach paper 16. However, print heads are known wherein the opposite is true, and the present invention can be used in conjunction with either type of print head.

Figure 2:
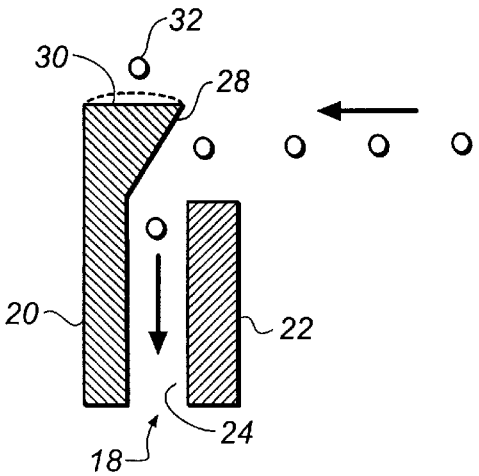
FIGS. 2 and 3 are fragmentary vertical section views of a catcher assembly which illustrate a problem solved by the present invention.

FIG. 2 is provided to illustrate a problem solved by the present invention. It is a fragmentary vertical section view of catcher assembly 18 of FIG. 1. As droplets to be caught strike bottom section 20, there is a certain amount of splatter and mist, even though an impact surface 28 has been chamfered to reduce the splatter and mist. A broad surface 30 at the end of bottom section 20 is subject to ink buildup, or "pooling" as indicated by the broken lines. Eventually, the height of the ink built up on surface 30 may incroach on the path of ink droplets 32 to be printed. This necessitates additional separation of the paths of the deflected and non-deflected droplets.

Figure 3:
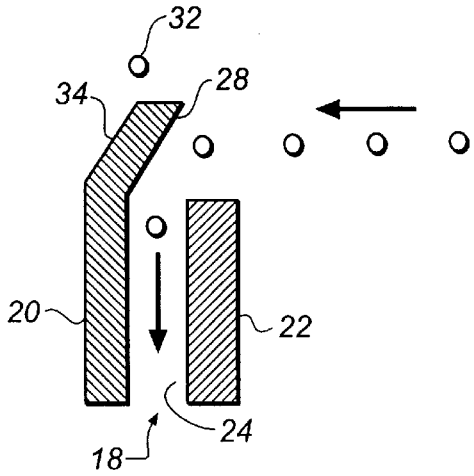

FIG. 3 illustrates a partial accommodation of the problem of ink buildup. By chamfering the back surface 34 of bottom section 20, the ink build up is moved away from the path of droplets 32 to be printed. However, the buildup is not eliminated.

Figure 5:
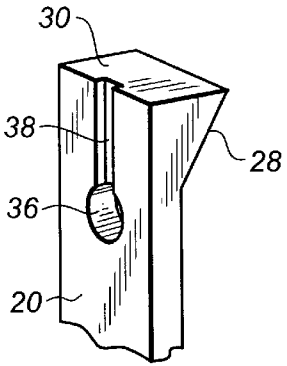
FIG. 5 is a perspective view of a portion of the catcher assembly of FIG. 4.
Figure 4:
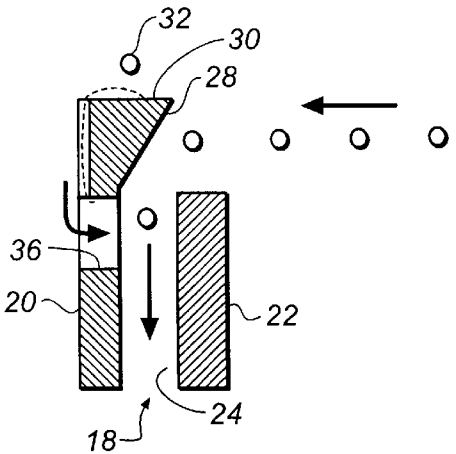
FIG. 4 is a fragmentary vertical section view of a catcher assembly according to the present invention.

FIGS. 4 and 5 illustrate a solution to the problem of ink buildup according to the present invention. FIGS. 4 and 5 correspond to FIG. 2 except that a hole 36 is provided through bottom section 20 from the back of the bottom section to ink collection chamber 24. The ink collection chamber is connected to a vacuum source so that any ink at the back of the bottom section is sucked through hole 36 to the ink removal conduit. A slot 38 is formed in the back of the bottom section to form a path to hole 36 for any ink tending to pool on broad surface 30.

Figure 6:
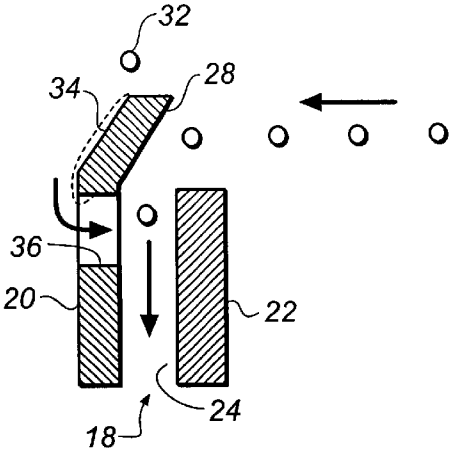
FIG. 6 is a fragmentary vertical section view of a catcher assembly according to another embodiment of the present invention.

FIG. 6 illustrates another solution to the problem of ink buildup according to the present invention. By chamfering back surface 34 of bottom section 20, any ink build up is moved away from the path of droplets to be printed to the chamfered region. A hole 36 is provided through bottom section 20 from the back of the bottom section to ink collection chamber 24 so that any ink in the back of the chamfered region is sucked through hole 36 to the ink removal conduit.

Figure 8:
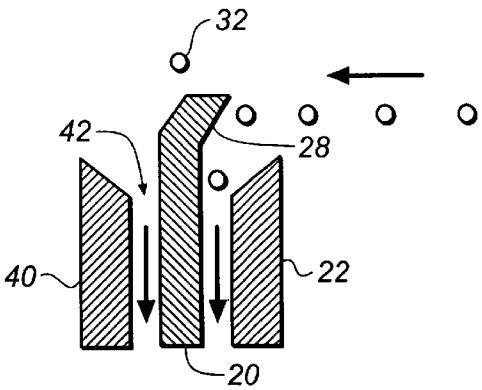
FIG. 8 is a fragmentary vertical section view of a catcher assembly according to another embodiment of the present invention.
Figure 7:
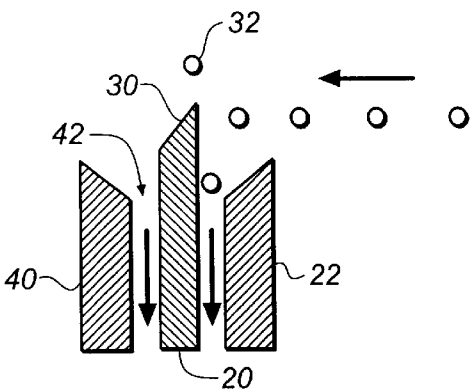
FIG. 7 is a fragmentary vertical section view of a catcher assembly according to another embodiment of the present invention.

FIGS. 7 and 8 illustrate two embodiments of the present invention that may prove simpler to manufacture than the earlier illustrated embodiments, and which would overcome any weakening of the bottom section 20 that might result from providing a hole 36 through the bottom section. In FIG. 7, bottom section 20 has a chamfered edge 30 to reduce pooling. Note that the end of cap 22 has also been chamfered for the same reason. Rather than providing a hole through bottom section 20 for returning ink that has pooled on the bottom section, a backing plate 40 forms an ink return conduit 42 with bottom section 20. In FIG. 8, the impact surface 28 of bottom section 20 has been formed at an angle to the direction of ink droplet travel to reduce splatter and misting, and the back surface of the bottom section is chamfered to reduce pooling. A backing plate 40 spaced from section 20 forms a conduit 42 extending from said other surface to the ink collection chamber.

The invention has been described in detail with particular reference to preferred embodiments thereof, but it will be understood that variations and modifications can be effected within the spirit and scope of the invention.

What is claimed is:

1. An ink catcher assembly for an ink jet printing head which is adapted to form a stream of spaced ink droplets that impact upon recording media and which includes a control device for selectively deflecting individual ones of the droplets to differentiate between print and non-print droplets; said catcher assembly being adapted to catch the non-print droplets while not catching the print droplets, and comprising:

a section defining an ink collection chamber and an impact surface positioned to intercept non-print droplets and to direct the intercepted non-print droplets to the ink collection chamber, said section further defining at least one other surface that is subject to undesirable ink build up; and an ink flow path extending from said other surface to the ink collection chamber whereby ink that has undesirably built up on said other surface will tend to flow to the ink collection chamber.

2. An ink catcher assembly as defined in claim 1 wherein said impact surface is chamfered relative to the stream of ink droplets to thereby reduce splatter and misting of intercepted non-print droplets.

3. An ink catcher assembly as defined in claim 1 wherein said ink flow path further includes a slot in the section extending between the hole and said other surface to provide a path for ink to flow from the other surface to the hole and then through the hole to the ink collection chamber.

4. An ink catcher assembly as defined in claim 1 wherein said ink flow path is a hole through the section, said hole extending from said other surface to the ink collection chamber.

5. An ink catcher assembly as defined in claim 1 wherein said ink flow path is formed by a backing plate spaced from the section to form a conduit extending from said other surface to the ink collection chamber.

6. A process for collecting ink in an ink jet printing head which is adapted to form a stream of spaced ink droplets that impact upon recording media and which includes a control device for selectively deflecting individual ones of the droplets to differentiate between print and non-print droplets; said catcher assembly being adapted to catch the non-print droplets while not catching the print droplets, said process comprising:

defining an ink collection chamber;

defining an impact surface;

intercepting non-print droplets by the impact surface and directing the intercepted non-print droplets to the ink collection chamber;

defining at least one other surface that is subject to undesirable ink build up; and providing an ink flow path extending from said other surface to the ink collection chamber whereby ink that has undesirably built up on said other surface will tend to flow to the ink collection chamber.

* * * * *